US006986315B2

(12) United States Patent
Toya et al.

(10) Patent No.: US 6,986,315 B2
(45) Date of Patent: Jan. 17, 2006

(54) SEWING MACHINE NEEDLE

(75) Inventors: Yutaka Toya, Nagano (JP); Masahiro Muroga, Nagano (JP)

(73) Assignee: Organ Needle Co., Ltd., Nagano-ken (JP)

( * ) Notice: Subject to any disclaimer, the term of this patent is extended or adjusted under 35 U.S.C. 154(b) by 0 days.

(21) Appl. No.: 10/642,967

(22) Filed: Aug. 18, 2003

(65) Prior Publication Data

US 2004/0038000 A1 Feb. 26, 2004

(30) Foreign Application Priority Data

Aug. 23, 2002 (JP) ..... 2002-243197

(51) Int. Cl.
*D05B 85/00* (2006.01)

(52) U.S. Cl. ..... 112/222

(58) Field of Classification Search ..... 112/222, 112/224, 225, 302; 223/99, 102, 103, 104; 163/1, 5

See application file for complete search history.

(56) References Cited

U.S. PATENT DOCUMENTS 2,441,171 A * 5/1948 Schulz ..... 112/222
3,862,611 A * 1/1975 Kuromegawa ..... 112/222
3,929,082 A 12/1975 Zocher
3,954,072 A 5/1976 Zocher
4,458,614 A 7/1984 Iwashita
4,563,961 A * 1/1986 Beyer et al. ..... 112/222
6,318,281 B2 11/2001 Hillenbrand et al.
6,332,416 B1 * 12/2001 Wohnhas et al. ..... 112/222
6,332,417 B1 12/2001 Vornholt

FOREIGN PATENT DOCUMENTS

| | | |
|---|---|---|
| DE | 30 27 534 | 2/1982 |
| DE | 36 36 706 | 5/1988 |
| JP | 06254282 | 9/1994 |
| JP | 58-112584 | 12/1994 |

* cited by examiner

*Primary Examiner*—Ismael Izaguirre

(57) ABSTRACT

A sewing machine needle free from combined troubles of stitch skipping and fabric yarn breakage, irrespective of high-speed and multifunction sewing machines and diversified materials being used. The sewing machine needle includes a shank, a blade connected to the shank, a needle point formed at an extremity of the blade, a needle eye formed in the vicinity of the needle point, and a long groove extending from the needle eye along the blade. The blade is provided at a portion thereof where the scarf is formed with a crank in such a manner that a side of the portion is outwardly protruded in a direction opposite from the scarf with respect to a central axis of the needle. An end of the needle eye contiguous to the scarf is protruded outward by a predetermined height from a contour of the blade.

16 Claims, 8 Drawing Sheets

PRIOR ART

SEWING MACHINE NEEDLE

BACKGROUND OF THE INVENTION

1. Field of the Invention

The present invention relates to a sewing machine needle free from stitch skipping and fabric yarn breakage.

2. Description of the Related Art

Sewing machines used in sewing are roughly classified into ones for industrial use and ones for domestic use.

The industrial sewing machines are generally used at high-speed rotational speed from the viewpoint of pursuing productivity, and the rotational speed thereof may come up to as high as 8000 rpm. In automated industrial sewing machines, seams are formed in multi-directions but loops that are important for formation of the seams apt to become unstable under the influence of sewing threads having a certain twist angle.

A fabric feeding mechanism of automated sewing machines such as pattern seamers or cycle sewing machines employs an X-Y table to realize multi-directional sewing. When a tip of a rotary hook passes a scarf of a sewing machine needle, minute oscillations of the X-Y table cause a large shaking of the needle from the scarf thereof toward the needle point thereof. As a result, the tip of the rotary hook fails to catch a loop so that stitch skipping is liable to occur.

In order to suppress such stitch skipping arising from the shaking of the needle, the dimensions of a needle dropping hole of the rotary hook are lessened with respect to the thickness of an eye portion at the tip end of the sewing machine needle so that the clearance therebetween is decreased to reduce the shaking of the needle. This means that the thickness of the eye portion at the tip end of the needle is a critical factor for the sewing machine needles.

On the contrary, the household sewing machines have seldom experienced such problems so far unlike the industrial sewing machines since the former is basically used at a low rotational speed. Recently, however, more and more household sewing machines have come to employ an additional embroidery function. Since their mechanisms are similar to those of the automated sewing machines of the industrial sewing machines, the degree of severity for the sewing machines needles is increasing.

A variety of materials used for sewn products have diversely been developed. Recent tendency is toward frequent development of materials rich in stretchability, which have come to be used for sewn products called heavy products such as jeans, which use has not hitherto been present by any means.

Extremely delicate jersey-based materials have also come to be used for automobile seats and have posed another essential problem of fabric yarn breakage in addition to the sewing problems such as stitch skipping and needle breakage. Thus, recent years have not required addressing only a single sewing trouble as before but have required a high-quality sewing machine needle capable of effectively coping especially with combined troubles of stitch skipping and fabric yarn breakage.

In order to solve the stitch skipping problem accompanying speedup and multifunction of the sewing machines as well as diversification of materials, the conventional art has also developed for example a sewing machine needle as shown in FIG. 13A which has a scarf 53 positioned, toward a shank, adjacent to a needle eye 51 formed at the tip end of a blade 50, the scarf 53 being formed on the opposite surface to the surface on which a long groove 52 is formed, and a sewing machine needle as shown in FIG. 13B which has a scarf 53 further deepened by protruding a reverse side of the scarf 53 in the form of a crank 54.

In the case of attempting to deal with further speedup and multifunction of the sewing machines and further material diversification, effective functions and qualities are required to suppress not only the stitch skipping but also the fabric yarn breakage. However, satisfactory measures could not be provided for the combined troubles of stitch skipping and fabric yarn breakage merely by forming the scarf 53 as in FIG. 13A or deepening the scarf 53 by the presence of the crank 54 as in FIG. 13B.

With the sewing machine needle shown in FIG. 13A, puncture resistance is so small due to the absence of the crank that the fabric yarn breakage may seldom occur, but the scarf 53 can not be formed to be very deep, making it impossible to thoroughly eliminate the occurrence of the stitch skipping.

With the sewing machine needle shown in FIG. 13B, the stitch skipping can effectively be suppressed since the deep scarf 53 can be formed by the presence of the crank 54, whereas the puncture resistance becomes larger due to the crank 54 protruding to a great extent and the fabric yarn breakage easily occurs. Furthermore, when the height of protrusion of the crank 54 is increased to obtain a deeper scarf 53, a throat plate and a rotary hook in general use may become unusable, which may possibly require frequent replacement with dedicated parts suited for this type of sewing machine needle, posing a problem in terms of the handling and operability.

For the purpose of solving the combined troubles of stitch skipping and fabric yarn breakage, another type of sewing machine needle has also been proposed which includes a scarf and a crank and which has a curved concave portion formed at an eye web portion of the sewing machine needle to thereby lower the resistance occurring when the needle penetrates the fabric (see, e.g., Japanese Patent Application Laid-Open Publication No. 2000-325685). It is however difficult for this sewing machine needle to completely solve the combined troubles of stitch skipping and fabric yarn breakage.

The above-described deepening of the scarf is generally known as a measure for solving the combined troubles of stitch skipping and fabric yarn breakage caused by the speedup and multifunction of the sewing machines and the diversification of materials. In the case of the sewing machine needle free from the crank as in FIG. 13A, however, if the scarf 53 is deepened, the thickness of a portion of the blade having the scarf 53 formed therein becomes thin, resulting in the strength thereof being lowered, which may possibly bring about frequent needle breakage or frequent stitch skipping due to its insufficient strength.

Even though the scarf 53 is deepened by the formation of the crank 54 as shown in FIG. 13B, the needle may not penetrate a fabric 55 straight since the needle is subjected to an increased resistance at the crank 54 when it passes through the fabric 55, whereby the needle is bent during penetrating the fabric. When the needle is excessively bent, the needle is brought into a direct collision with the throat plated or a needle guard, resulting in a needle breakage.

As set forth above, more all-round functions and qualities are required for the sewing machine needles used in the current sewing machines which operate at enhanced speeds and which are made multifunctional, in combination with the diversified materials.

Requirements of sewing machine needles suited to the high-speed sewing machines are to have an ability to form loops required for the seam formation with desired dimensions and with less deviation, as well as to have a sufficient strength for withstanding high-speed motions.

Requirements of sewing machine needles suited to the multi-directional sewing machines are to have a well-balanced strength in all directions through 360 degrees and to have a deep scarf serving to prevent the stitches from skipping even though any leaning loop occurs since, due to the certain twisted directions of the sewing thread, loops will lean when the amount of the sewing thread used for the loop formation is too much, with the result that the stitch skipping is prone to occur.

Heretofore, plain weave fabrics, moquette, tricot, carpet, leather, etc., have been used as materials for the automobile seats. These materials have rarely experienced the fabric yarn breakage problem even though relatively thick sewing machine needles have penetrated them. With remarkable progress of the materials as described above, jersey-based materials have often come to be used in recent years, resulting in frequent occurrence of the fabric yarn breakage problem in sewing using such materials. Although as a measure against such situation, thinner sewing machine needles of No. 2 to No. 5 count have been used, there still remain secondary problems such as stitch skipping and needle breakage because of the sewing machine needles having insufficient strength.

Similar problems have been seen in the field of jeans sewing or shoes sewing, and the combined troubles of stitch skipping and fabric yarn breakage have been a traditional major problem in knit fabric sewing and foundation garment or lingerie sewing.

SUMMARY OF THE INVENTION

The present invention has been made in order to solve the above problems. It is therefore an object of the invention to provide a high-quality sewing machine needle free from combined troubles of stitch skipping and fabric yarn breakage, irrespective of high-speed and multifunction sewing machines and diversified materials being used.

To attain the above object, according to the present invention, there is provided a sewing machine needle. The sewing machine needle includes a shank, a blade connected to the shank, a needle point formed at the extremity of the blade, a needle eye formed in the vicinity of the needle point, and a long groove extending from the needle eye along the blade, wherein the blade is provided on a surface thereof diametrically apart from the long groove with a scarf which is formed to be recessed at a shank side of the needle eye; the blade is provided at a portion thereof where the scarf is formed with a crank in such a manner that a side of the portion is outwardly protruded in a direction opposite from the scarf with respect to a central axis of the needle; and an end of the needle eye contiguous to the scarf is protruded outward by a predetermined height from a contour of the blade. It is preferable in terms of the puncture resistance that the total dimension of the protruded height of the crank and the protruded height of the end of the needle eye be set to be within 30% of a height of the blade in a depth direction of the long grove.

Such construction permits the crank to have a reduced height and the end of the needle eye and the crank to protrude symmetrically in the diametrically opposite directions with respective to the central axis of the needle, resulting in that the resistance during penetrating the fabric is remarkably lowered as compared with the conventional sewing machine needle, so that the probability of occurrence of the fabric yarn breakage can be reduced. Furthermore, the stitch skipping in sewing can also be prevented since a deeper scarf can be formed by the combined effects of the crank and the protruded end of the needle eye.

It is preferable that opposite sidewalls of the needle eye include tops which have the same height as that of the end of the needle eye. Such construction can further lessen damage to a needle thread when the needle penetrates the fabric.

It is preferable that a needle eye portion of the blade in the vicinity of the needle point is configured to have a straight form extending parallel to the central axis of the needle. Such construction can reduce the clearance between the needle and a needle dropping hole in a rotary hook during sewing to thereby suppress shaking of the needle, resulting in the probability of occurrence of the stitch skipping being further reduced.

It is preferable that the blade be formed to have a sectional shape of which a height in a depth direction of the long groove is equal to or more than a width thereof in a width direction of the long groove. Such construction can further enhance the strength of the blade in the depth direction of the long groove, to thereby further reduce the magnitude of the shaking of the needle.

It is preferable that the blade be provided at least on opposite side surfaces thereof with concave portions. Such construction can further reduce the contact resistance of the needle with the fabric, to thereby decrease the probability of occurrence of the fabric yarn breakage as well as lower the needle heat.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE INVENTION

Figure 1A:
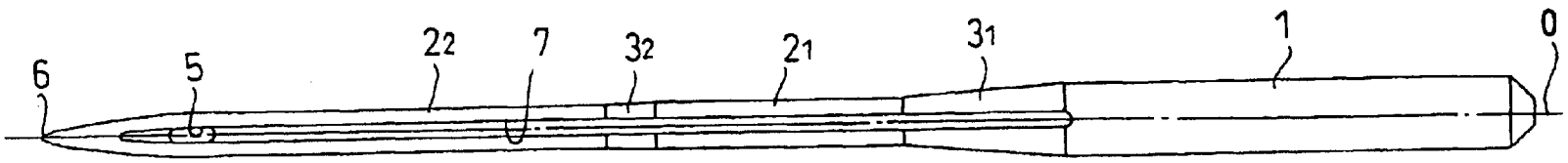
FIGS. 1A and 1B illustrate a first embodiment of a sewing machine needle in accordance with the present invention, FIG. 1A being an enlarged plan view showing an overall shape of the sewing machine needle, and FIG. 1B being a longitudinal sectional view of the needle taken along its central axis.
Figure 1B:
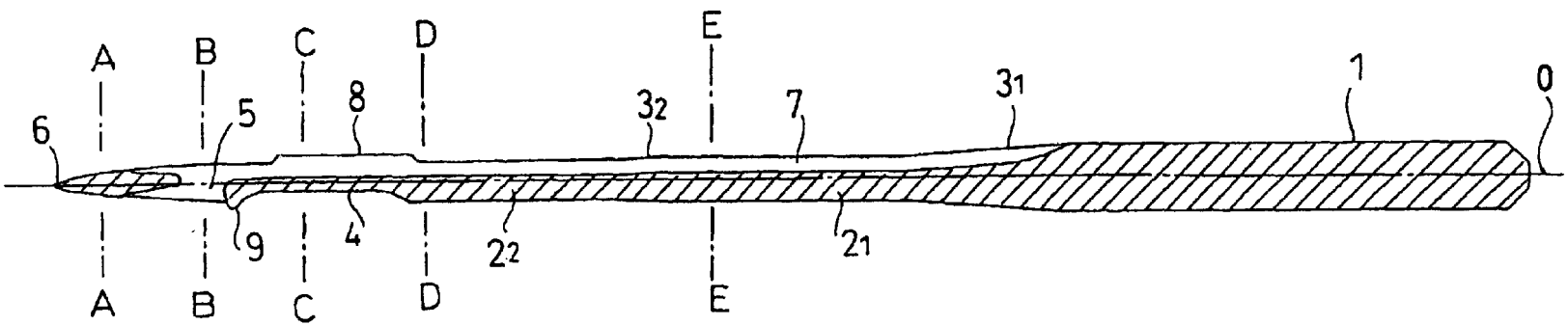
Figure 2:
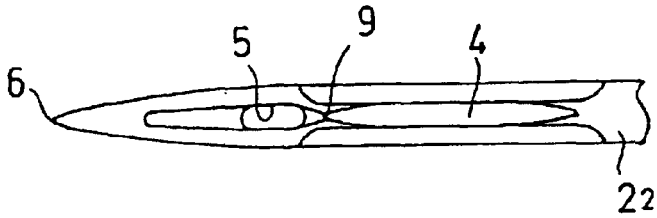
FIG. 2 is an enlarged rear view of a needle point portion of the needle.

Embodiments of the present invention will now be described with reference to the drawings.

Referring first to FIG. 1A to FIG. 3E, a first embodiment of a sewing machine needle in accordance with the present invention is illustrated.

In the figures, reference numeral 1 denotes a shank, reference numeral $\mathbf{2}_1$ denotes a second blade connected to the shank 1 via a first taper $\mathbf{3}_1$, reference numeral $\mathbf{2}_2$ denotes a first blade with narrow diameter connected to the second blade $\mathbf{2}_1$ via a second taper $\mathbf{3}_2$, reference numeral 4 denotes a scarf formed on a tip side of the first blade $\mathbf{2}_2$, and reference numerals 5, 6 and 7 denote a needle eye, a needle point and a long groove, respectively.

Figure 3A:
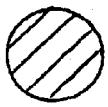
FIGS. 3A to 3E are enlarged sectional views which illustrate parts of the sewing machine needle according to the first embodiment, taken along lines A—A to E—E of FIG. 1B, respectively.
Figure 3B:
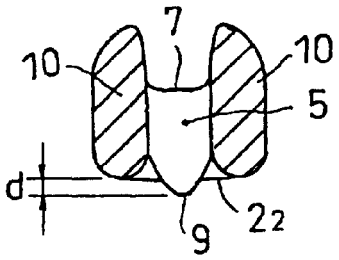
Figure 3C:
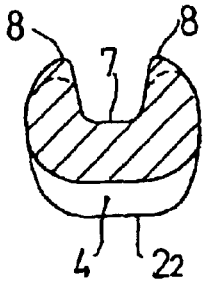

The scarf 4 is positioned adjacent to the needle eye 5 toward the shank 1 and formed on an opposite surface to a surface on which the long groove 7 is formed. For the purpose of increasing strength of a portion of the first blade $\mathbf{2}_2$ formed with the scarf 4, the portion is outwardly protruded at a side thereof opposite from the scarf 4 to form a crank 8. As shown in FIG. 3B, an end 9 of the needle eye 5 contiguous to the scarf 4 protrudes outward by a predetermined height d from the contour of the first blade $\mathbf{2}_2$ to form a convex protuberance. Reference numeral 10 denotes opposite sidewalls of the needle eye 5.

Figure 3D:
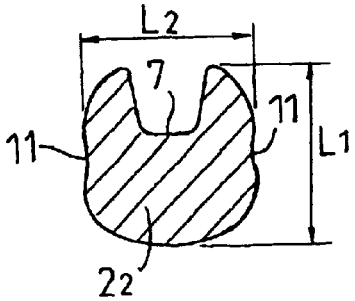
Figure 3E:
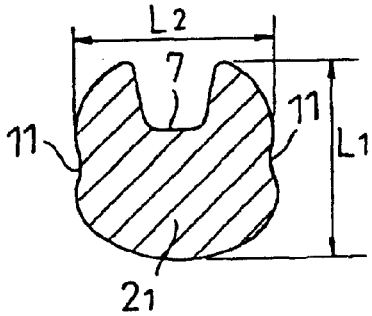

For the purpose of minimizing the contact resistance when the needle penetrates fabric, the second blade $\mathbf{2}_1$ and first blade $\mathbf{2}_2$ including the tapers $\mathbf{3}_1$ and $\mathbf{3}_2$ are provided on the opposite outer side surfaces thereof with concave portions 11, respectively as shown in FIGS. 3D and 3E. The concave portions 11 may be formed to extend along the needle eye 5 portion to the needle point 6 in addition to the blades.

In the first embodiment, in order to increase the strength of the blades in a depth direction of the long groove 7, as shown in FIGS. 3D and 3E, the first blade $\mathbf{2}_2$ and the second blade $\mathbf{2}_1$ are each formed to have a sectional profile such that the height $L_1$ in the depth direction and the width $L_2$ in a width direction of the long groove 7 are equal or that the height $L_1$ is greater than the width $L_2$.

Figure 4:
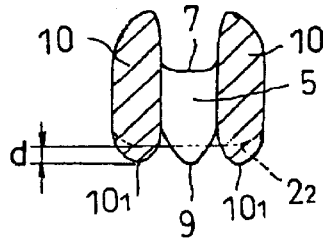
FIG. 4 is a cross sectional view illustrating another example of the shape of a needle eye portion.

Although in the illustrated embodiment, only the end 9 of the needle eye 5 protrudes outward by the height d from the contour of the first blade $\mathbf{2}_2$, tops $\mathbf{10}_1$ of both sidewalls 10 of the needle eye 5 may also extend up to the same height as that of the end 9 of the needle eye 5 so as to be level with the protruded end 9 of the needle eye 5 as shown in FIG. 4. In this manner, the tops $\mathbf{10}_1$ of the sidewalls 10 of the needle eye 5 on a level with the needle eye end 9 can lessen damage to a needle thread when the needle thread passes the needle eye end 9, to thereby suppress the occurrence of breakage of the needle thread.

The sewing machine needle according to the first embodiment has overcome the combined troubles of fabric yarn breakage and stitch skipping by the protrusion of the needle eye end 9 so as to increase the depth of the scarf 4 as far as possible while limiting the outward protruded height of the crank 8 as low as possible.

Figure 5:
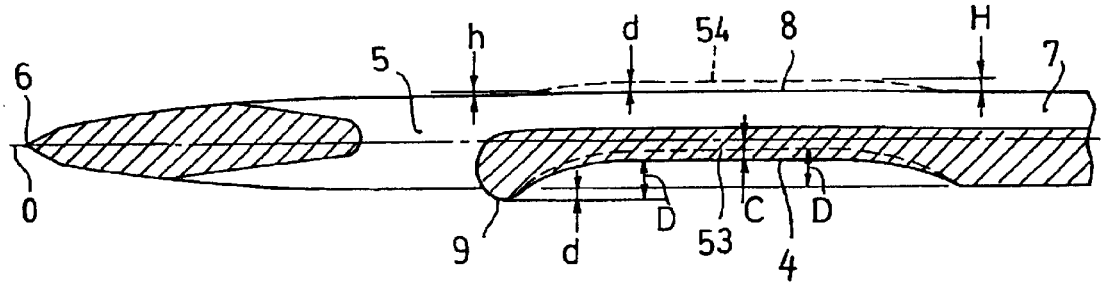
FIG. 5 is an explanatory view illustrating action of the sewing machine needle according to the first embodiment.

Referring now to FIG. 5, the essential part of the sewing machine needle of the present invention is illustrated in comparison with that of the conventional sewing machine needle. Assuming that in the conventional sewing machine needle provided only with a crank 54, the crank 54 needs to have a height H in order to form a scarf 53 having a depth D as indicated by dotted lines in FIG. 5, it is possible for the sewing machine needle of the present invention having the needle eye end 9 protruded by the height d to shallow the bottom surface of the scarf 4 by the dimension equal to the protruded height d of the needle eye end 9 in order to form the scarf 4 having the same depth D. Accordingly, it is possible, as shown in FIG. 5, to reduce the protruded height H of the crank 54 by the level difference between the bottom portions of the scarves, i.e., in the present invention, the protruded height h of the crank 8 can be reduced to h=H−d.

Thus, by virtue of formation of such a sufficient deep scarf 4, the loop can securely be caught by a tip of the rotary hook during sewing, so that stitch skipping can be prevented from occurring. Concurrently, since the height of the crank 8 can be lower than that of the conventional sewing machine needle, the resistance becomes smaller when the needle penetrates the fabric, resulting in the fabric yarn breakage being prevented. Furthermore, due to the lowered puncture resistance during penetrating the fabric, bending of the needle hardly occurs and thus the needle will not collide with the throat plate or needle guard, resulting in the needle breakage being prevented.

It is desirable that the sum (d+h) of the protruded height d of the needle eye end 9 and the protruded height h of the crank 8 be set to be within 30% of the height $L_1$ of the first blade $\mathbf{2}_2$ in a depth direction of the long groove 7 (see FIG. 3D).

Figure 6A:
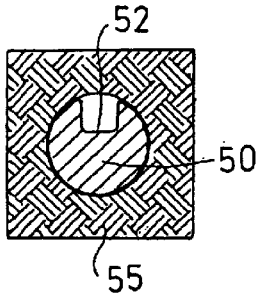
FIG. 6A is a schematic view illustrating the status where a conventional sewing machine needle penetrates a fabric.
Figure 6B:
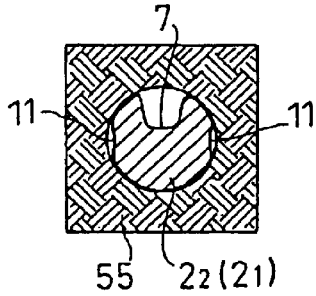
FIG. 6B is a schematic view illustrating the status where the sewing machine needle according to the first embodiment penetrates the fabric.

In the first embodiment, since the concave portions 11, as shown in FIGS. 3D and 3E, are formed on both sidewalls of the first blade $\mathbf{2}_2$ and the second blade $\mathbf{2}_1$, there are gaps between the needle and the fabric 55 by the presence of the concave portions 11 as shown in FIG. 6B when the needle penetrates the fabric 55, so that the contact area can become smaller to lower the contact resistance, resulting in the puncture resistance and needle heat during penetrating the fabric being reduced. To the contrary, in the case of the conventional sewing machine needle having no concave portion, the entire outer peripheral surfaces of the blade 50 come into contact with the fabric 55 as shown in FIG. 6A, with the result that the puncture resistance and needle heat during penetrating the fabric become increased.

Figure 7:
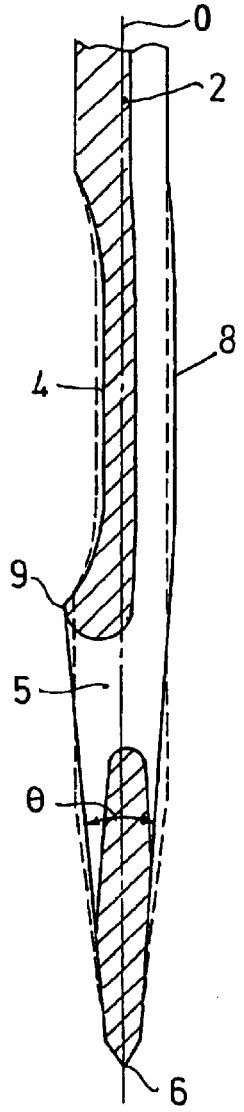
FIG. 7 is a diagrammatic explanatory view of the needle point portion of the sewing machine needle according to the first embodiment.

In the first embodiment, as shown in FIG. 7, a taper is formed from the vicinity of the top of the protruded end 9 of the needle eye 5 toward the needle point 6 unlike the conventional sewing machine needle indicated by dotted lines, whereby the taper angle θ of the needle point portion becomes smaller, so that it is possible to obtain a more sharply pointed needle point 6 as compared with the conventional sewing machine needle.

Furthermore, in the case where as shown in FIG. 4, the tops $\mathbf{10}_1$ of the opposite sidewalls 10 of the needle eye 5 are level with the top of the protruded end 9 of the needle eye 5, it is possible to protect the needle thread to thereby reduce damage to the needle thread.

Figure 8A:
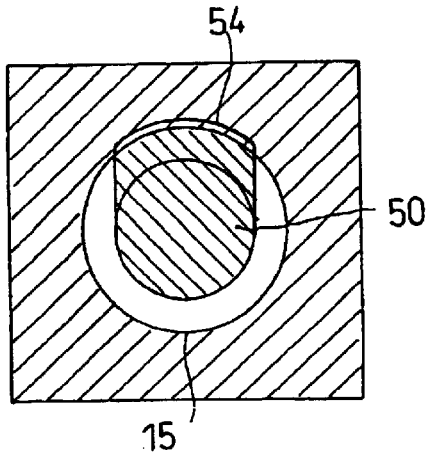
FIGS. 8A and 8B each illustrate the locus of the sewing machine needle when the needle penetrates a hole in a throat plate, FIG. 8A being a locus diagram obtained by the conventional sewing machine needle, and FIG. 8B being a locus diagram obtained by the sewing machine needle of the present invention.
Figure 8B:
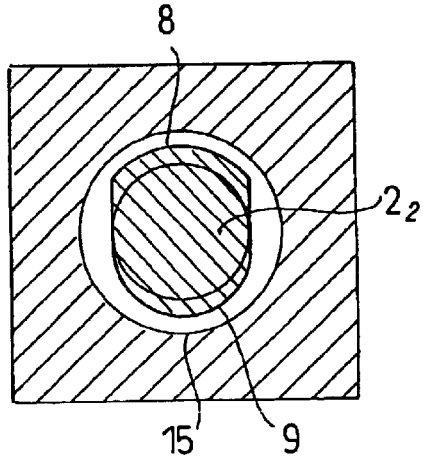
Figure 9A:
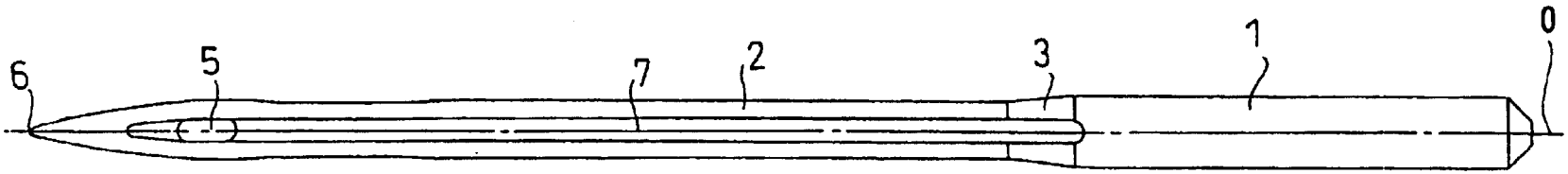
FIGS. 9A and 9B illustrate a second embodiment of a sewing machine needle in accordance with the present invention, FIG. 9A being an enlarged plan view showing an overall shape of the sewing machine needle, and FIG. 9B being a longitudinal sectional view of the needle taken along its central axis.
Figure 9B:
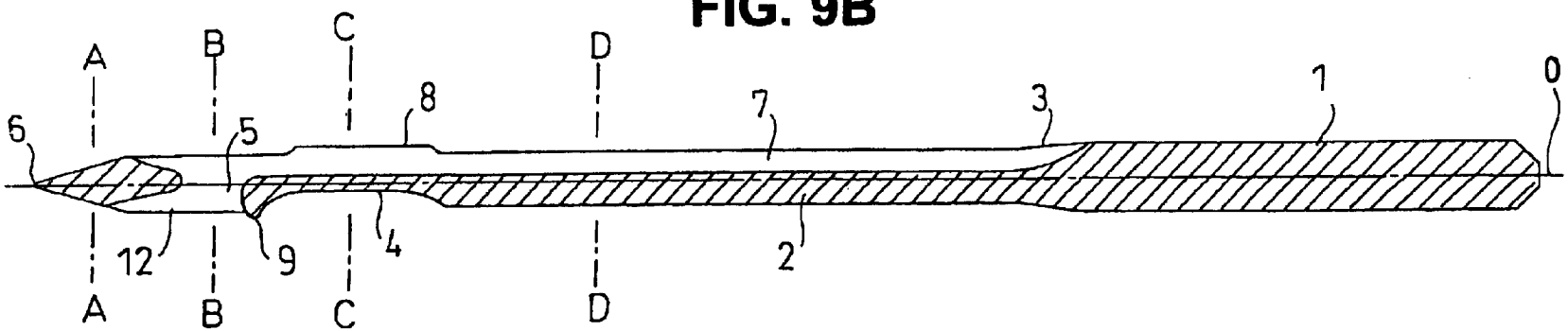
Figure 10:
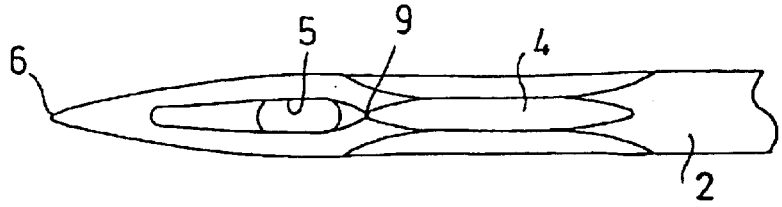
FIG. 10 is an enlarged rear view of the needle point portion of the needle.
Figure 13A:
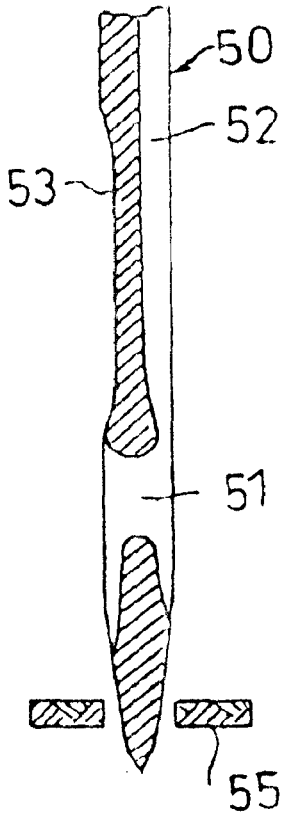
FIGS. 13A and 13B illustrate examples of the shape of the conventional sewing machine needle, FIG. 13A being a schematic enlarged sectional view of a needle point portion of the sewing machine needle provided with only a scarf, and FIG. 13B being a schematic enlarged sectional view of a needle point portion of the sewing machine needle provided with a scarf and a crank.
Figure 13B:
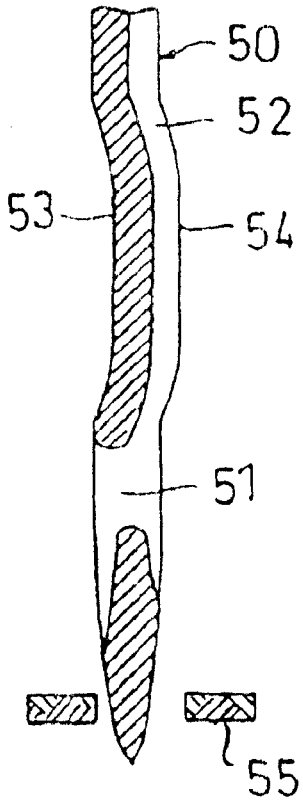
PRIOR ART FIG. 13B

Referring to FIGS. 8A and 8B, the locus of the sewing machine needle when it penetrates the hole in the throat plate is illustrated, wherein FIG. 8A is a locus diagram obtained by the conventional sewing machine needle of FIG. 13B, whilst FIG. 8B is a locus diagram obtained by the sewing machine needle of the present invention.

In the conventional sewing machine needle, as shown in FIG. 8A, the crank 54 of a large size protrudes only in one direction from the blade 50, and hence it may be difficult for the needle to penetrate a hole 15 of the throat plate depending on the size of the crank 54. On the contrary, in the sewing machine needle of the present invention, as shown in FIG. 8B, the needle eye end 9 projects from the blade 22 on the side diametrically opposed to the crank 8 and the protruded height of the crank 8 is reduced because of the protruded end 9 of the needle eye 5, with the result that the protruding portions of the crank 8 can be accommodated inside the hole 15 of the throat plate. For this reason, any existing throat plate can be used intactly, making unnecessary a work such as replacing it with a dedicated part.

Referring next to FIGS. 9A to 11D, a second embodiment of a sewing machine needle in accordance with the present invention is illustrated. It is to be noted that the same reference numerals are imparted to portions identical or equivalent to those of the first embodiment and that the detailed explanations of these portions will not again be repeated.

Figure 11A:
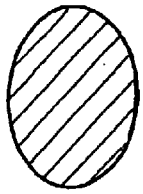
FIGS. 11A to 11D are enlarged sectional views which illustrate parts of the sewing machine needle according to the second embodiment, taken along lines A—A to D—D of FIG. 9B, respectively.
Figure 11B:
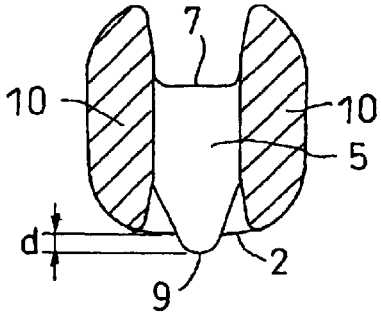
Figure 11C:
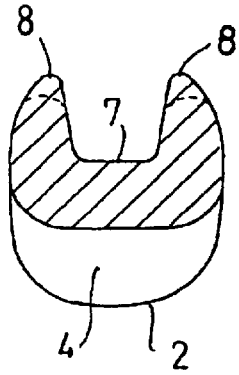
Figure 11D:
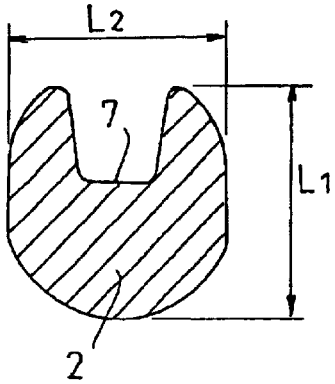

The sewing machine needle according to the second embodiment exemplifies a sewing machine needle having a shape suited to the automated sewing machines and the like, and merely differs from the sewing machine needle of the first embodiment in that a blade 2 employs a single-stage constitution, that a needle eye portion 12 (see FIG. 9B) at the tip end of the needle is configured to have an elongated straight form (e.g., the length of the straight portion is approximately 2 mm) extending parallel to the central axis 0 of the needle, with a needle point being of an ellipsoidal conical shape (see FIG. 11A), and that no concave portion is formed on the opposite sidewall surfaces of the blade 2 (see FIG. 11D).

Figure 12A:
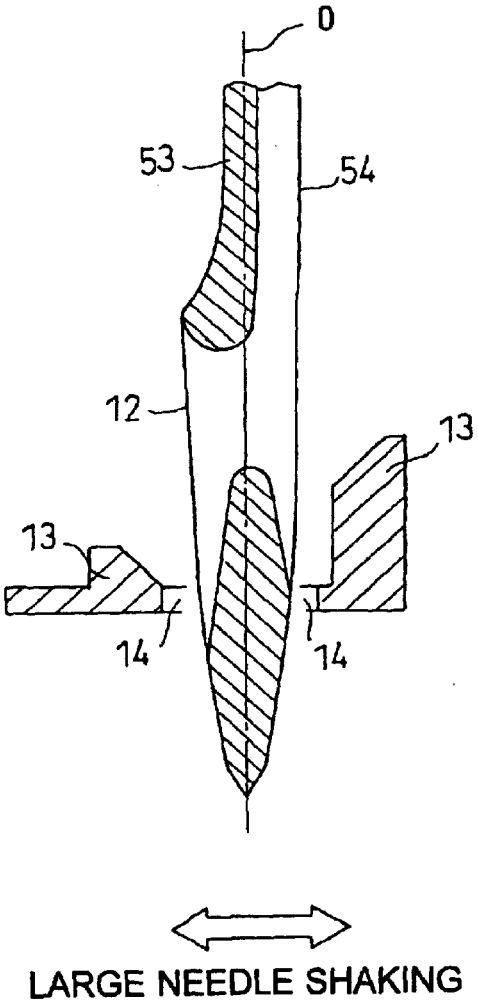
FIGS. 12A and 12B illustrate the status of clearance between a needle dropping hole of a rotary hook and the needle point portion of the needle, FIG. 12A being a sectional view with respect to the conventional sewing machine needle, and FIG. 12B being a sectional view with respect to the sewing machine needle according to the second embodiment.
Figure 12B:
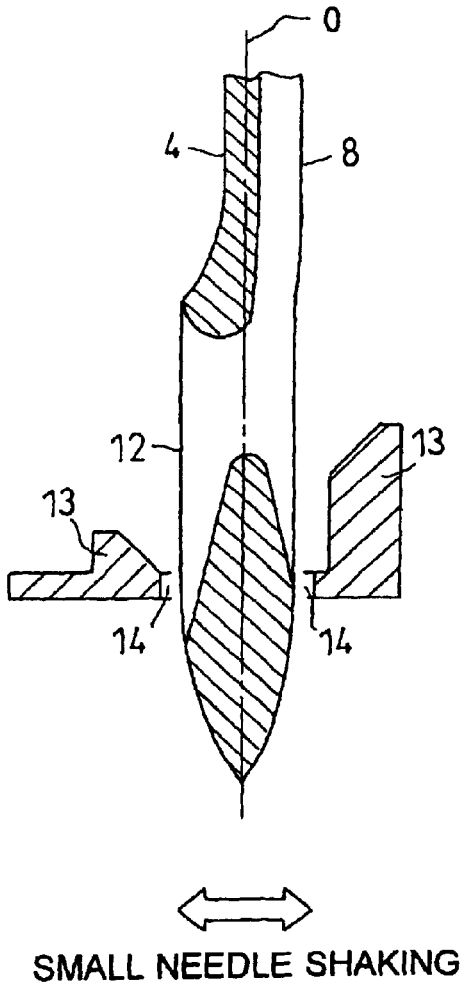

When the needle eye portion 12 is configured to have the elongated straight form as in the second embodiment, it is possible as shown in FIG. 12B to reduce the clearance 14 between the needle and a needle dropping portion 13 or needle dropping hole of the rotary hook during sewing to thereby suppress shaking of the needle to a small magnitude, resulting in the stitch skipping being further reduced. In the case where the straight portion is short, the clearance 14 between the needle and the needle dropping portion 13 of the rotary hook becomes larger as shown in FIG. 12A, resulting in shaking of the needle being larger. The shapes as well as the actions and effects of the other portions are similar to those of the first embodiment, and hence details thereof will be omitted.

Although the sewing machine needles according to the first and second embodiments which are exemplarily illustrated are provided only with the long groove as a thread groove, it is a matter of course that the present invention is applicable to a sewing machine needle provided with a known short groove as well.

As set forth above, according to the sewing machine needle of the present invention, the blade is provided on the surface thereof diametrically apart from the long groove with the scarf which is formed to be recessed at the shank side of the needle eye; the blade is provided at a portion thereof where the scarf is formed with the crank in such a manner that a side of the portion is outwardly protruded in a direction opposite from the scarf with respect to a central axis of the needle; and the end of the needle eye contiguous to the scarf is protruded outward by a predetermined height from the contour of the blade. Such construction permits the protruded height of the crank to be reduced to lower the puncture resistance against the fabric, whereby the fabric yarn breakage can be reduced. Also, such construction permits the scarf to be formed deeper by the combination of the protruded end of the needle eye and the crank form of the blade portion having the scarf formed, to thereby prevent the stitch skipping. Accordingly, it becomes possible to effectively cope with the combined troubles of stitch skipping and fabric yarn breakage which may arise from the use of high-speed and multifunction sewing machines and diversified fabric materials.

By utilization of both the gentle crank and the protruded end of the needle eye which protrude symmetrically in diametrically opposite directions with respect to the central axis of the needle, the radially protruded distance for each part of the sewing machine needle can be limited to about a half of that of the conventional sewing machine needle even when the same scarf depth is to be obtained. It is therefore possible to lower the puncture resistance during penetrating fabric to thereby prevent bending of the needle and to make unnecessary the use of the dedicated sewing machine parts.

In one preferred embodiment of the present invention, the tops of the sidewalls of the needle eye are level with the top of the protruded end of the needle eye. Such construction can reduce damage to the needle thread at the needle eye end.

In one preferred embodiment of the present invention, the needle eye portion at the tip end of the needle is configured to have a straight form extending parallel to the central axis of the needle. Such construction can further reduce the clearance between the needle and the needle dropping hole of the rotary hook to thereby further suppress shaking of the needle, resulting in the stitch skipping being prevented more positively.

In one preferred embodiment of the present invention, the blade is formed to have a sectional shape of which the height in a depth direction of the long groove is equal to or more than a width thereof in a width direction of the long groove. Such construction can enhance the strength of the blade in the depth direction of the long groove.

In one preferred embodiment of the present invention, the blade is provided at least on the opposite side surfaces thereof with the concave portions. Such construction can reduce the contact resistance with the fabric to thereby reduce the fabric yarn breakage and the needle heat.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A sewing machine needle comprising a shank, a blade connected to said shank, a needle point formed at an extremity of said blade, a needle eye formed in the vicinity of said needle point, and a long groove extending from said needle eye along said blade, wherein said blade is provided on a surface thereof diametrically apart from said long groove with a scarf which is formed to be recessed at a shank side of said needle eye;

said blade is provided at a portion thereof where said scarf is formed with a crank in such a manner that a side of said portion is outwardly protruded in a direction opposite from said scarf with respect to a central axis of the needle; and an end of said needle eye contiguous to said scarf is protruded outward by a predetermined height from a contour of said blade.

2. The sewing machine needle according to claim 1, wherein the total dimension of a protruded height of said crank and said protruded height of said end of said needle eye is set to be within 30% of a height of said blade in a depth direction of said long groove.

3. The sewing machine needle according to claim 1, wherein opposite sidewalls of said needle eye include tops which have the same height as that of said end of said needle eye.

4. The sewing machine needle according to claim 2, wherein opposite sidewalls of said needle eye include tops which have the same height as that of said end of said needle eye.

5. The sewing machine needle according to claim 1, wherein a needle eye portion of said blade in the vicinity of said needle point is configured to have a straight form extending parallel to said central axis of the needle.

6. The sewing machine needle according to claim 2, wherein a needle eye portion of said blade in the vicinity of said needle point is configured to have a straight form extending parallel to said central axis of the needle.

7. The sewing machine needle according to claim 3, wherein a needle eye portion of said blade in the vicinity of said needle point is configured to have a straight form extending parallel to said central axis of the needle.

8. The sewing machine needle according to claim 1, wherein said blade is formed to have a sectional shape of which a height in a depth direction of said long groove is equal to or more than a width thereof in a width direction of said long groove.

9. The sewing machine needle according to claim 2, wherein said blade is formed to have a sectional shape of which a height in a depth direction of said long groove is equal to or more than a width thereof in a width direction of said long groove.

10. The sewing machine needle according to claim 3, wherein said blade is formed to have a sectional shape of which a height in a depth direction of said long groove is equal to or more than a width thereof in a width direction of said long groove.

11. The sewing machine needle according to claim 5, wherein said blade is formed to have a sectional shape of which a height in a depth direction of said long groove is equal to or more than a width thereof in a width direction of said long groove.

12. The sewing machine needle according to claim 1, wherein said blade is provided at least on opposite side surfaces thereof with concave portions.

13. The sewing machine needle according to claim 2, wherein said blade is provided at least on opposite side surfaces thereof with concave portions.

14. The sewing machine needle according to claim 3, wherein said blade is provided at least on opposite side surfaces thereof with concave portions.

15. The sewing machine needle according to claim 5, wherein said blade is provided at least on opposite side surfaces thereof with concave portions.

16. The sewing machine needle according to claim 8, wherein said blade is provided at least on opposite side surfaces thereof with concave portions.

* * * * *